US006488267B1

(12) United States Patent
Goldberg et al.

(10) Patent No.: US 6,488,267 B1
(45) Date of Patent: Dec. 3, 2002

(54) APPARATUS FOR LIFTING OR PULLING A LOAD

(75) Inventors: Alan L. Goldberg, APO AE (DE); John F. Lanza, Natick, MA (US); Reed W. Hoyt, Framingham, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/660,082

(22) Filed: Sep. 12, 2000

(51) Int. Cl.[7] ..... B66D 1/00
(52) U.S. Cl. ..... 254/264
(58) Field of Search ..... 254/264, 228

(56) References Cited

U.S. PATENT DOCUMENTS

| | | | | | |
|---|---|---|---|---|---|
| 1,120,741 | A | * | 12/1914 | Petrie | 114/51 |
| 3,266,776 | A | * | 8/1966 | Catu | 254/228 |
| 3,886,631 | A | * | 6/1975 | Caradot | 24/134 N |
| 4,448,393 | A | * | 5/1984 | Habegger et al. | 254/228 |
| 4,456,226 | A | * | 6/1984 | Stumpmeier | 226/112 |
| 4,580,658 | A | | 4/1986 | Brda | 182/5 |
| 4,593,884 | A | * | 6/1986 | Zschocke et al. | 226/112 |
| 4,615,509 | A | * | 10/1986 | Biass | 254/228 |
| 4,634,101 | A | * | 1/1987 | Lauber | 254/228 |
| 4,667,772 | A | | 5/1987 | Kammerer | 182/6 |
| 4,712,772 | A | * | 12/1987 | Negrutsky et al. | 188/65.1 |
| 5,029,669 | A | | 7/1991 | Lew et al. | 182/42 |
| 5,400,869 | A | | 3/1995 | Rocourt | 182/133 |
| 5,655,754 | A | * | 8/1997 | Perrier | 226/112 |
| 5,931,265 | A | | 8/1999 | Hollowell et al. | 187/407 |
| 6,164,397 | A | * | 12/2000 | Appleton et al. | 180/7.1 |

* cited by examiner

*Primary Examiner*—Emmanuel Marcelo
(74) *Attorney, Agent, or Firm*—Vincent J. Ranucci

(57) ABSTRACT

An apparatus configured to be movably mounted upon a rope for lifting and pulling a load as the apparatus travels along the rope. The apparatus can also be used to retract a rope. In one embodiment, the apparatus comprises a pneumatic cylinder having first and second gas ports for receiving and venting a pressurized gas. The cylinder includes a piston and piston rod that move in response to the pressurized gas. A portion of the piston extends from the cylinder. The apparatus further comprises a first ascender and a second ascender. The first ascender is attached to the portion of the piston rod that extends from the cylinder. The second ascender is attached to the cylinder. Each ascender comprises a body through which a rope passes and a locking device that allows movement of the ascender, with respect to the rope, in a first direction, and prevents movement of the ascender, with respect to the rope, in a second direction. The second ascender includes means for attaching a load. When the apparatus is used to lift a load, pressurized gas is alternately introduced into one port and vented from the other port thereby causing the apparatus to climb the rope along with the load. When the apparatus is used to retract a rope, the attaching means of the second ascender is anchored to a secure object. Pressurized gas is alternately introduced into one port and vented from the other port so as to cause movement of the piston and piston rod in the first and second directions. When the piston rod moves in the second direction, the locking device of the first ascender clamps onto the rope thereby retracting the rope in the second direction.

5 Claims, 4 Drawing Sheets

APPARATUS FOR LIFTING OR PULLING A LOAD

The invention described herein may be manufactured, and used by the U.S. Government for Governmental purposes without the payment of any royalty thereon.

BACKGROUND OF THE INVENTION

1. Field of the Invention

The present invention generally relates to a devices for lifting or pulling or heavy objects.

2. Problem to be Solved

Winches are typically used to lift heavy loads or pull loads across horizontal obstacles. Winches are either motor-driven or hand powered and utilize a drum around which a wire rope (i.e. metal cable) or chain is wound. However, the winding of the wire rope or cable around the drum often results in undue stress on the cable or rope thereby causing the cable or rope to become tangled or stuck. Manually lifting or pulling heavy objects is not a viable option due to the strength required to lift or pull such objects. Often, fatigue and injury result from manually lifting or pulling such objects.

It is therefore an object of the present invention to provide an apparatus for lifting or pulling heavy loads which solves the problems associated with the conventional methods and techniques described above.

It is another object of the present invention to provide an apparatus for lifting or pulling heavy loads which can be manufactured at reasonable costs.

Other objects and advantages of the present invention will be apparent to one of ordinary skill in the art in light of the ensuing description of the present invention.

SUMMARY OF THE INVENTION

The present invention is directed to an apparatus that is configured to be movably mounted upon a rope for lifting or pulling a load as the apparatus travels along the rope. The apparatus can also be used to retract a rope.

In one embodiment, the apparatus comprises a device having a housing and a chamber configured for receiving a pressurized medium. The device further includes first and second port in communication with the chamber for receiving and venting the pressurized medium. The apparatus further includes a member that is movably disposed within the chamber and has a portion extending from the chamber. The member is movable in a first direction when the pressurized medium is introduced into the first port, and in a second direction when the pressurized medium is introduced into the second port. The apparatus further comprises a first braking device attached to the portion of the member extending from the chamber. The first braking device is configured to be movably mounted upon a rope. The first braking device comprises a body through which the rope passes and a locking device movably attached to the body. The locking device allows movement of the first braking device, with respect to the rope, in the first direction, and prevents movement of the first braking device, with respect to the rope, in the second direction. The apparatus further comprises a second braking device attached to the housing.

The second braking device is configured to be movably mounted upon a rope. The second braking device comprises a body through which the rope passes and a locking device movably attached to the body of the second braking device. The locking device allows movement of the second braking device, with respect to the rope, in the first direction, and prevents movement of the second braking device, with respect to the rope, in the second direction. The second braking device includes means for attaching the second braking device to an object.

If the apparatus is to be used for lifting or pulling a load, the attaching means is used to attach the load to the second braking device. If the apparatus is to be used to retract a rope, wire or cable, the attaching means is used to attach the second braking device to an anchoring object, e.g. tree, pole, vehicle bumper, boulder, etc.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

Figure 1:
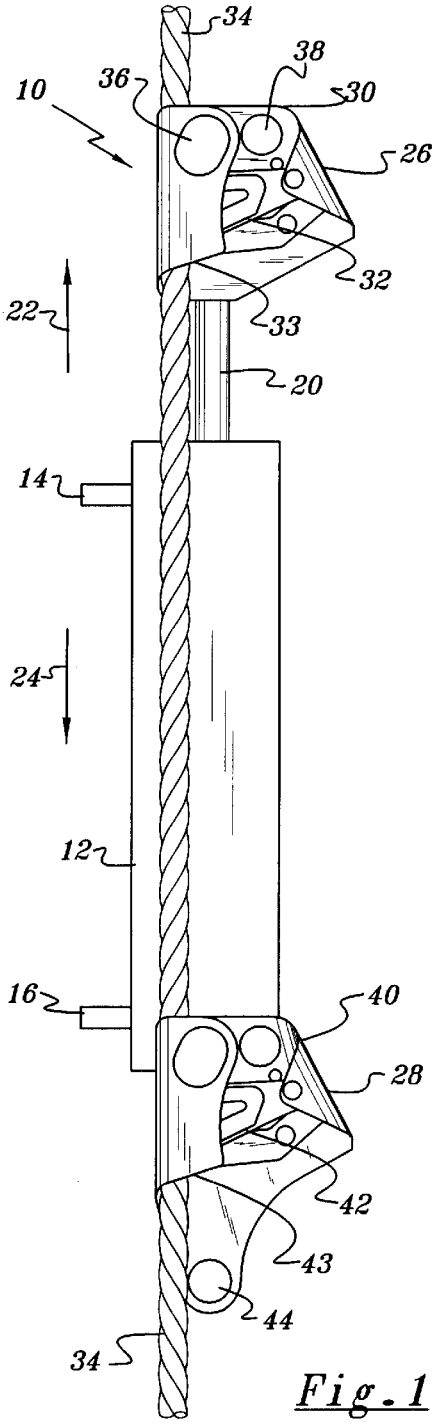
FIG. 1 is a front elevational view of the apparatus of the present invention.

Referring to FIG. 1, apparatus 10 of the present invention generally comprises pneumatic cylinder 12. In one embodiment, pneumatic cylinder 12 comprises a standard double action, non-rotating pneumatic cylinder. One such pneumatic cylinder is manufactured by SMC Pneumatics, Inc. of Indianapolis, Indiana under model number NCD-MKE 150-1200C-G59. However, other pneumatic cylinders having generally the same operational characteristics can also be used. Pneumatic cylinder 12 has ports 14 and 16 that are in gaseous communication with the interior chamber of cylinder 12 and which receive pressurized gas. Cylinder 12 further includes a piston 18 (see FIGS. 5–8) and piston rod 20 that is attached to piston 18. Piston 18 is movable within the interior chamber of cylinder 12. Thus, piston 20 can move in the direction indicated by arrows 22 and 24 in FIG. 1. When pressurized gas is injected into port 16 and such gas attains a threshold pressure within cylinder 12, piston 18 is moved upward thereby causing piston rod 20 to move in the direction indicated by arrow 22. When gas is injected into port 14 and such gas attains a threshold pressure, piston 18 is moved downward thereby causing piston rod 20 to move downward in the direction indicated by arrow 24, and the pressurized gas within the portion of cylinder 12 that is beneath piston 18 to vent though port 16. Similarly, injecting gas into port 16 would cause piston 18 to move upward thereby venting gas through port 14. The pressurized gas can be one of a variety of cold or hot gases. Such cold gases include air, propane, nitrogen, carbon dioxide, etc. which can be provided by a compressor, pressurized tank. or other suitable pressurized gas sources. The hot gases include gases produced from a chemical reaction, e.g. an air bag, propane combustion, etc.

Figure 3:
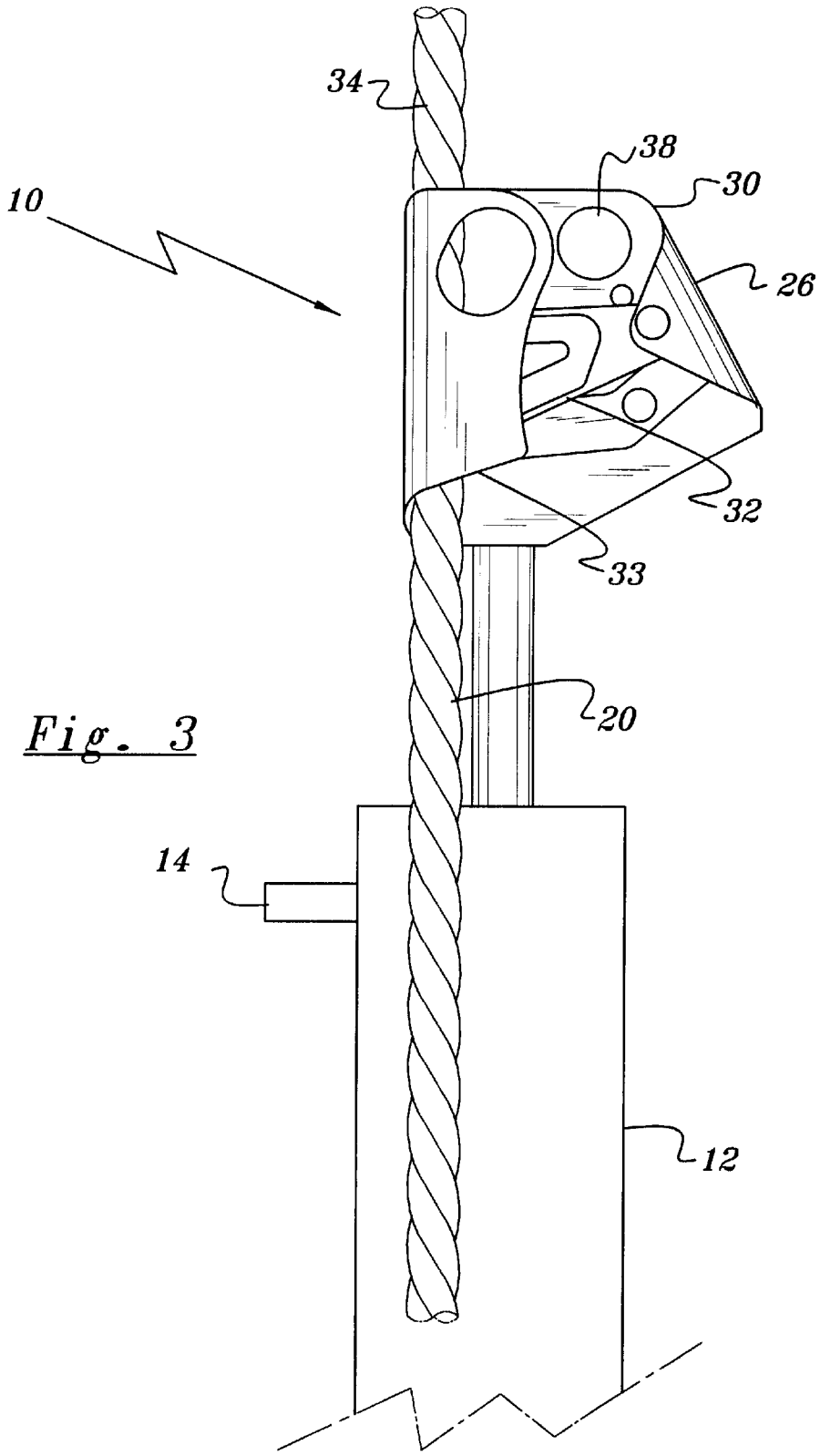
FIG. 3 is a front elevational view of a top portion of the apparatus of FIG. 1.
Figure 4:
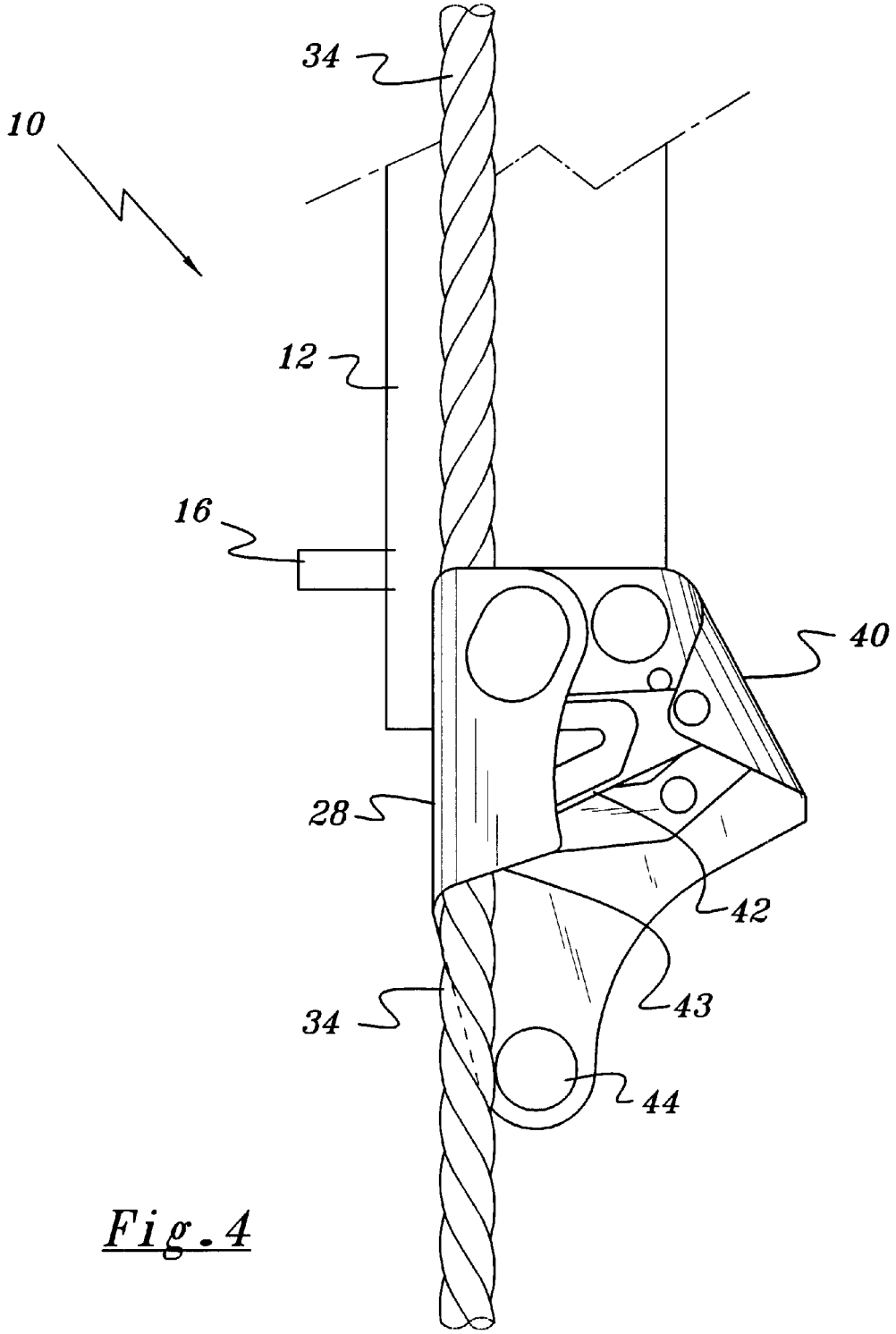
FIG. 4 is a front elevational view of a bottom portion of the apparatus of FIG. 1.

Referring to FIGS. 1, 3 and 4, apparatus further comprises upper braking device 26 and lower braking device 28. Upper braking device 26 is attached to one end of piston rod 20. Lower braking device 28 is attached to lower portion of cylinder 12. In one embodiment, upper and lower braking devices 26 and 28, respectively, are configured as ascenders. Ascenders are well known in the field of mountain climbing and are described in U.S. Pat. No. 5,400,869, the disclosure of which is incorporated herein by reference. In one embodiment, upper and lower braking devices 26 and 28, respectively, are each configured as the Model B08 ascender manufactured by Petzl S. A. of Crolles, France. However, other ascenders having similar characteristics can also be used. Although the ensuing description is in terms of braking devices 26 and 28 being configured as ascenders, it is to be understood that other braking devices having operating characteristics generally . similar to ascenders can also be used. Ascenders are unidirectional and can moved in the direction in which they are mounted.

Referring to FIG. 3, ascender 26 comprises a body 30 and a jamming catch 32 that is movably attached to body 30. Rope, cable, braided cable, metal cable, or wire (collectively referred to herein as "rope") 34 passes through channel 33 formed within body 30. Jamming catch 32 has a rope contacting portion configured to have slanted teeth (not shown). These slanted teeth grip rope 34 when a downward force is exerted upon ascender 26. Thus, when a downward force is exerted upon ascender 26, ascender 26 is configured into a locked position. However, jamming catch 32 allows upward movement of ascender 26 with respect to rope 34. Thus, an upward force on ascender 26 will configure ascender 26 into an unlocked position. Body portion 30 includes openings 36 and 38 that can be used for receiving an optional safety rope or cable as well as facilitating storage of apparatus 10 when not in use.

Referring to FIG. 4, ascender 28 comprises a body 40 and a jamming catch 42 that is movably attached to body 40. Rope 34 passes through channel 43 formed within body 40. Jamming catch 42 has a rope contacting portion configured to have slanted teeth (not shown). These slanted teeth grip rope 34 when a downward force is exerted upon ascender 28. Thus, when such a downward force is exerted upon ascender 28, ascender 28 is configured into the locked position. However, jamming catch 42 allows upward movement of ascender 28 with respect to rope 34. Thus, an upward force on ascender 28 will configure ascender 28 into the unlocked position. Body portion 40 includes opening 44 to which is fastened load 48 (see FIGS. 5–8). In some instances, load 48 can be fastened directly to opening 44. In other instances, rope 50 is secured to load 48 and other end of rope 50 is fastened to opening 44.

Figure 5:
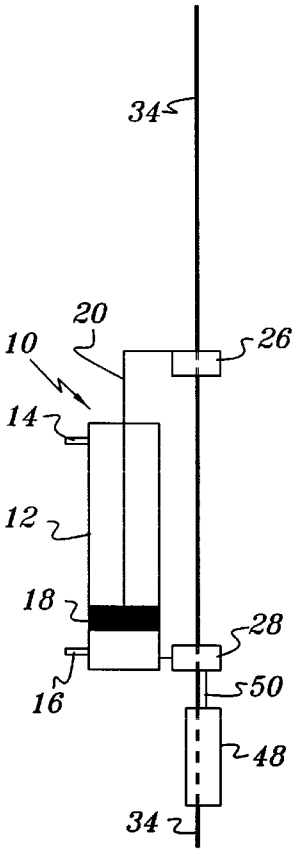

FIGS. 5–8 illustrate the operation of apparatus 10. The top end of rope 34 is secured to a fixed object, e.g. tree, boom, etc. while the rest of rope 34 hangs down. Referring to FIG. 5, load 48 is secured to lower ascender 28 via rope 50 and causes a downward force to be exerted upon cylinder 12. Thus, ascenders 26 and 28 are in the locked position. Initially, piston 18 is located at the bottom of cylinder 12. When pressurized gas is injected into lower gas port 16, an upward force is applied to piston 18 thereby causing piston 18, piston rod 20 and upper ascender 26 to move upward (i.e. in the direction indicated by arrow 22 shown in FIG. 1) with respect to cylinder 12 and rope 34. Upper ascender 26 is now in the unlocked position since ascender 26 is moving upward with respect to rope 34. However, gravity is acting upon cylinder 12 and load 48 causing a downward force to act upon lower ascender 28. As a result of this force, lower ascender 28 is configured in the locked position thereby maintaining cylinder 12 and load 48 stationary while piston 18, piston rod 20 and upper ascender 26 move upward.

Figure 7:
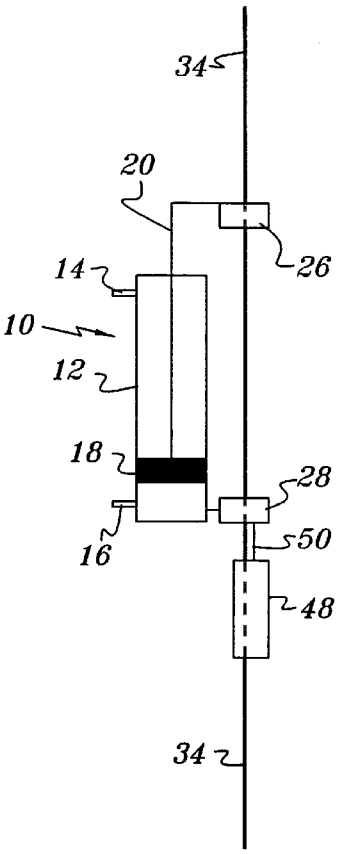
Figure 6:
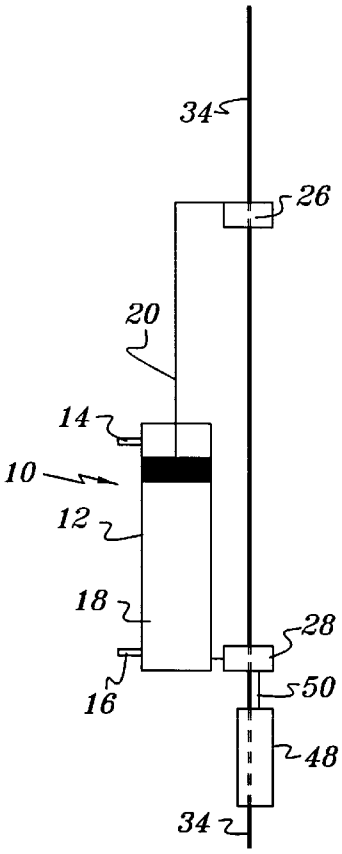

Referring to FIG. 6, piston 18 is now positioned within the top portion inner chamber of cylinder 12. Thus, piston rod 20 extends from cylinder 12 the maximum distance possible. Next, pressurized gas is injected into upper gas port 14 thereby causing a downward force to act upon piston 18. The downward force upon piston 18 effects a transferal of weight from lower ascender 28 to upper ascender 26. Thus, upper ascender 26 is shifted into the locked position and lower ascender 28 is shifted into the unlocked position. Referring to FIG. 7, the downward pressure or force exerted upon piston 18 results in an equal and opposite force which pushes cylinder 12, and the attached lower ascender 28, upward upon rope 34 while piston 18, piston rod 20 and upper ascender 26 remain stationary. As cylinder 12 moves upward, gas is vented from the interior chamber of cylinder 12 through gas port 16.

Referring to FIG. 7, cylinder 12 moves a maximum distance upward such that piston 18 is now once again positioned at the bottom portion of the inner chamber of cylinder 12. Pressurized gas is now introduced into lower gas port 16 thereby causing an upward force to be applied to piston 18. As a result, upper ascender 26 is shifted into the unlocked position and piston 18, piston rod 20 and upper ascender 26 move upward with respect to rope 34. Gravity meanwhile causes lower ascender 28 to re-lock thereby preventing cylinder 12 and load 48 from descending rope 34.

Figure 8:
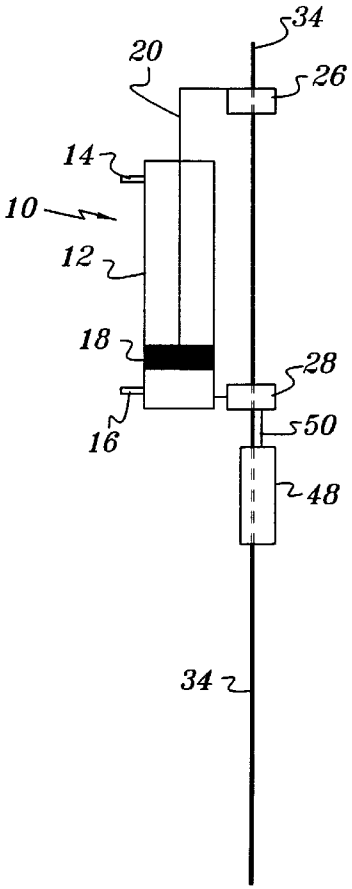
FIGS. 5–8 are schematic diagrams illustrating the movement of the apparatus of FIG. 1 along a wire rope or cable.

These steps of alternately applying pressurized gas to gas ports 14 and 16 and then alternately allowing the gas to vent from gas ports 14 and 16 continues until cylinder 12 attains the desired height, as shown in FIG. 8. The locking and unlocking of upper and lower ascenders 26 and 28, respectively, is automatic due to the transference of the weight of load 48 to the appropriate ascender at the end of each piston stroke cycle.

In another embodiment, lower ascender 28 is configured so that opening 44 is generally aligned with rope 34 in order to prevent rope chaffing and torquing of apparatus during operation thereof.

Apparatus 10 of the present invention can also be used as a rope puller. In order to use apparatus 10 in this manner, rope 34 is securely anchored to a fixed point such as a tree, boom, vehicle bumper, etc. Apparatus 10 is positioned on rope 34 such that ascender 26 is positioned between a load or object to be lifted or pulled and ascender 28. Rope 34 runs through both ascenders 26 and 28 and is attached to the load or object. When pressurized gas is applied to gas port 16, piston rod 18 and upper ascender 26 move along rope 34 in the direction of the load. During the return stroke, when pressurized gas is directed into gas port 14, the teeth of jamming catch 32 of ascender 26 clamps onto rope 34 thereby pulling both rope 34 and the load inward toward the anchored position. This process continues until the load is positioned at the desired position. As each section of rope 34 is pulled in by apparatus 10, slack builds up between ascenders 26 and 28. A person or automatic rope tensioner can be used to remove the slack by pulling the rope through ascender 28.

Figure 2:
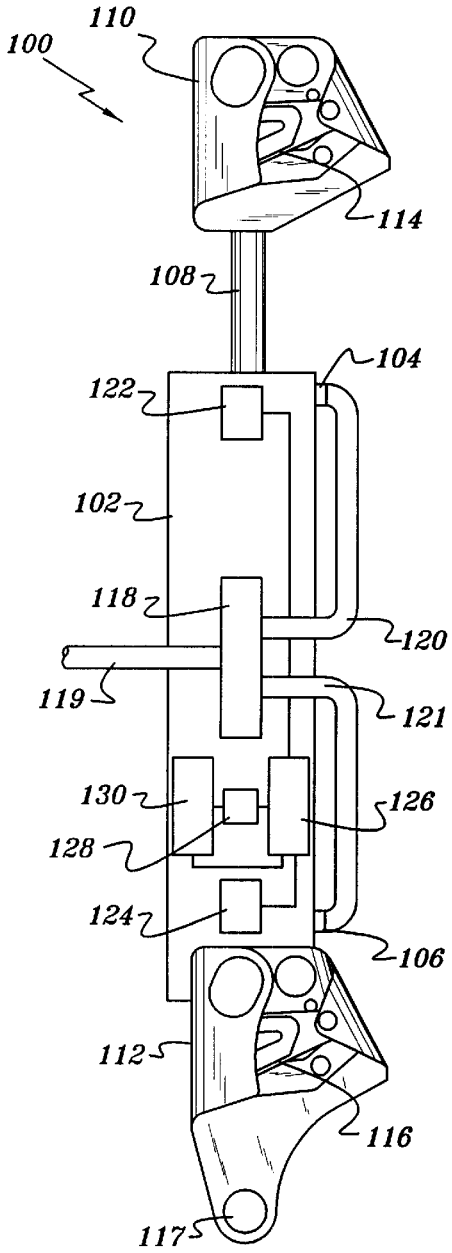
FIG. 2 is a front elevational view of an alternate embodiment of the apparatus of the present invention.

Referring to FIG. 2, there is shown another embodiment of the apparatus of the present invention. Apparatus 100 generally comprises pneumatic cylinder 102 which generally functions in the same manner as cylinder 12. Cylinder 102 includes gas ports 104 and 106 that are in gaseous communication with the interior chamber of cylinder 102 and which receive pressurized air or gas. Cylinder 102 further includes a piston (not shown) and piston rod 108 that is attached to the piston (not shown). The piston (not shown) and piston rod 108 function in the same manner as piston 18 and piston rod 20, respectively, described in the foregoing description. Apparatus 100 further comprises upper braking device 110 and lower braking device 112. In one embodiment, braking devices 110 and 112 are configured as ascenders of the type that were described in the foregoing description. Braking devices 110 and 112 includes jamming catches 114 and 116, respectively. Jamming catches 114 and 116 function in generally the same manner jamming catches 32 and 42, respectively, which were described in the foregoing description. Lower braking device 112 includes opening 117 to which a load can be attached.

Referring to FIG. 2, apparatus 100 further includes an electronically controlled directional control valve 118 that is attached to cylinder 102. Valve 118 includes inlet 119 that is gaseously coupled to a pressurized gas source (not shown) and outlets 120 and 121 through which gas flows to gas ports 104 and 106. Valve 118 directs gas into one of these gas ports while allowing gas to vent from the other gas port. In one embodiment, valve 118 is a four-way control valve. One such valve is manufactured by SMC Pneumatics, Indianapolis, Ind. as the model number NVJ5000. Apparatus 100 further includes piston position sensors 122 and 124 that are attached to the upper and lower portions, respectively, of cylinder 102. Sensors 122 and 124 transmit an electronic signal to valve 118 whenever the piston (not shown) is in close proximity to sensors 122 and 124. Thus, when the piston (not shown) is in close proximity to one of the piston position sensors, that sensor transmits a signal to valve 118. In response, valve 118 redirects the flow of gas to the gas port (either gas port 104 or 106) near which the piston is located and allows gas to vent from the other gas port thereby effecting a change in direction of the movement of the piston. Similarly, when the piston (not shown) passes near the other piston position sensor, this sensor transmits a signal to valve 118 in order to redirect the flow of pressurized gas to the gas port adjacent this position sensor thereby causing the piston to move in the previous direction. In one embodiment, sensors 122 and 124 are configured as Hall Effect sensors. However, other types of sensors having generally the same characteristics as the Hall Effect sensors can be used. In such a configuration, cylinder 12 is fabricated from non-ferrous, stainless steel and piston 18 is configured to have embedded magnets that allow sensors 122 and 124 to detect the position of piston 18.

Referring to FIG. 2, apparatus 100 further comprises micro-controller 126 that is mounted to cylinder 102. Micro-controller 126 is electrically connected to valve 118, and piston position sensors 122 and 124. Micro-controller 126 is programmed with instructions by the user. Micro-controller 126 uses these instructions, the position of the piston as detected by sensors 122 and 124, and valve 118 to control the stroke, repetition rate and pressurization of cylinder 102. Apparatus further includes switch 128 and battery power source 130 which are mounted to cylinder 102 and electrically connected between battery power source 130 and micro-controller 126. Battery power source 130 provides power to piston position sensors 122 and 124, valve 118 and micro-controller 126. When switch 128 is configured to have a first state, operation of apparatus 100 is initiated. When switch 128 is configured to have a second state, operation of apparatus 100 is terminated. Micro-controller 126 can be pre-programmed to automatically deactivate switch 128 to terminate operation of apparatus 100 when cylinder 102 attains a predetermined height. Micro-controller 126 allows the user to vary the pressure of the gas introduced into cylinder 102, and the stroke and repetition rate of piston 18.

In other embodiments of the present invention, a pneumatic cylinder is used which has a piston that automatically returns to the top of the pneumatic cylinder after reaching the bottom of the pneumatic cylinder. In one embodiment, a spring mechanism intrinsic to the cylinder could be used to automatically reposition the piston to the top of the cylinder after it reaches the bottom of the pneumatic cylinder. In another embodiment, the gas vented from one gas port is redirected to the other gas port so as to reposition the piston at the top of the cylinder. Such automatic repositioning of the piston reduces the amount of pressurized gas used in the overall operation of the apparatus of the present invention.

In a further embodiment of the present invention, cylinders 12 and 102 are configured as hydraulic cylinders that use hydraulic fluids rather than pressurized gas.

Apparatuses 10 and 100 are portable and easy to use. Apparatuses 10 and 100 do not utilize metal cable and drums which are typically used by conventional winches. Apparatuses 10 and 100 enable users to effortlessly lift loads, i.e. personnel or equipment, weighing as much as 500 pounds along rope 34. Thus, apparatuses 10 and 100 also substantially reduces risk of injury to users. Apparatuses 10 and 100 can be used in many situations, e.g. mountain climbing, search and rescue operations, military operations, etc. Apparatuses 10 and 100 can also be used by police and SWAT units during hostage situations, as well as by fire-fighting personnel.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention,

What is claimed is:

1. An apparatus for lifting or pulling a load, comprising:

a device having a housing and a chamber configured for receiving a pressurized medium, the device further including first and second ports in communication with the chamber for receiving and venting the pressurized medium, said device comprising a pneumatic cylinder;

a member movably disposed within the chamber and having a portion extending from the chamber, the member being movable in a first direction when the pressurized medium is introduced into the first port, and in a second direction when the pressurized medium is introduced into the second port, said member comprising a piston movably disposed within the chamber, and a piston rod having a first end attached to the piston and a second end extending from the chamber;

a first braking device configured to be movably mounted upon a rope, the first braking device being attached to the portion of the member extending from the chamber, the first braking device comprising a body through which the rope passes and a locking device movably attached to the body, the locking device allowing movement of the first braking device, with respect to the rope, in the first direction, and preventing movement of the first braking device, with respect to the rope, in the second direction; and a second braking device configured to be movably mounted upon a rope, the second braking device being attached to the housing, the second braking device comprising a body through which the rope passes and a locking device movably attached to the body of the second braking device, the locking device of the second braking device allowing movement of the second braking device, with respect to the rope, in the first direction, and preventing movement of the second braking device, with respect to the rope, in the second direction, the second braking device including means for attaching the second braking device to an object.

2. The apparatus according to claim 1 wherein the first braking device is attached to the second end of the piston rod.

3. The apparatus according to claim 1 wherein the first braking device comprises an ascender.

4. The apparatus according to claim 1 wherein the second braking device comprises an ascender.

5. The apparatus according to claim 1 further including a source of the pressurized medium for input into the first and second ports.

* * * * *